US007336920B2

(12) United States Patent
Anderson et al.

(10) Patent No.: US 7,336,920 B2
(45) Date of Patent: Feb. 26, 2008

(54) PRINTING SYSTEM

(75) Inventors: David G. Anderson, Ontario, NY (US); Steven R. Moore, Rochester, NY (US); Gerald M. Fletcher, Pittsford, NY (US); Bryan J. Roof, Fairport, NY (US); Eric S. Hamby, Fairport, NY (US); Robert M. Lofthus, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 141 days.

(21) Appl. No.: 11/235,979

(22) Filed: Sep. 27, 2005

(65) Prior Publication Data

US 2006/0067756 A1 Mar. 30, 2006

Related U.S. Application Data

(60) Provisional application No. 60/631,918, filed on Nov. 30, 2004, provisional application No. 60/631,921, filed on Nov. 30, 2004.

(51) Int. Cl.
*G03G 15/20* (2006.01)
*G03G 15/00* (2006.01)

(52) U.S. Cl. ..... 399/341; 399/407

(58) Field of Classification Search ..... 399/2, 399/67, 68, 107, 320, 322, 328, 341, 407
See application file for complete search history.

(56) References Cited

U.S. PATENT DOCUMENTS 4,579,446 A 4/1986 Fujino et al.
4,587,532 A 5/1986 Asano
4,791,447 A 12/1988 Jacobs
4,836,119 A 6/1989 Siraco et al.
4,928,148 A 5/1990 Higashi
5,004,222 A 4/1991 Dobashi
5,019,869 A 5/1991 Patton
5,053,828 A 10/1991 Ndebi et al.
5,080,340 A 1/1992 Hacknauer et al.
5,095,342 A 3/1992 Farrell et al.
5,159,395 A 10/1992 Farrell et al.
5,208,640 A 5/1993 Horie et al.
5,258,809 A 11/1993 Wiedemer
5,272,511 A 12/1993 Conrad et al.
5,296,904 A 3/1994 Jackson (Continued)

OTHER PUBLICATIONS

Morgan, P.F., "Integration of Black Only and Color Printers", Xerox Disclosure Journal, vol. 16, No. 6, Nov./Dec. 1991, pp. 381-383.

(Continued)

*Primary Examiner*—Sandra L. Brase
(74) *Attorney, Agent, or Firm*—Eugene O. Palazzo; Fay Sharpe LLP

(57) ABSTRACT

A printing system includes first and second marking devices for applying images to print media. A primary fusing device is associated with each of the first and second marking devices for applying a primary fusing treatment to the images applied to print media by the first and second marking devices. A secondary fusing module receives printed media from the first and second marking devices, the secondary fusing module including first and second secondary fusing devices which selectively apply a further fusing treatment to the images applied to the printed media.

19 Claims, 5 Drawing Sheets

U.S. PATENT DOCUMENTS 5,326,093 A 7/1994 Sollitt
5,402,220 A 3/1995 Tanaka et al.
5,435,544 A 7/1995 Mandel
5,436,710 A 7/1995 Uchiyama
5,459,561 A 10/1995 Ingram
5,473,419 A 12/1995 Russel et al.
5,489,969 A 2/1996 Soler et al.
5,504,568 A 4/1996 Saraswat et al.
5,506,671 A 4/1996 Buts et al.
5,525,031 A 6/1996 Fox
5,557,367 A 9/1996 Yang et al.
5,568,246 A 10/1996 Keller et al.
5,570,172 A 10/1996 Acquaviva
5,596,416 A 1/1997 Barry et al.
5,629,762 A 5/1997 Mahoney et al.
5,710,968 A 1/1998 Clark et al.
5,778,377 A 7/1998 Marlin et al.
5,848,331 A 12/1998 Fromm
5,884,910 A 3/1999 Mandel
5,890,032 A 3/1999 Aslam et al.
5,995,721 A 11/1999 Rourke et al.
6,016,409 A 1/2000 Beard et al.
6,059,284 A 5/2000 Wolf et al.
6,088,565 A 7/2000 Jia et al.
6,125,248 A 9/2000 Moser
6,212,357 B1 4/2001 Boehmer et al.
6,241,242 B1 6/2001 Munro
6,297,886 B1 10/2001 Cornell
6,341,773 B1 1/2002 Aprato et al.
6,384,918 B1 5/2002 Hubble, III et al.
6,393,245 B1 5/2002 Jia et al.
6,450,711 B1 9/2002 Conrow
6,476,376 B1 11/2002 Biegelsen et al.
6,476,923 B1 11/2002 Cornell
6,487,338 B2 11/2002 Aswawa
6,487,388 B2 11/2002 Theodoulou et al.
6,493,098 B1 12/2002 Cornell
6,512,914 B2 * 1/2003 Kabashima ..... 399/341
6,532,351 B2 3/2003 Richards et al.
6,535,712 B2 3/2003 Richards
6,537,910 B1 3/2003 Burke et al.
6,550,762 B2 4/2003 Stoll
6,554,276 B2 4/2003 Jackson et al.
6,577,925 B1 6/2003 Fromherz
6,607,320 B2 8/2003 Bobrow et al.
6,608,988 B2 8/2003 Conrow
6,612,566 B2 9/2003 Stoll
6,612,571 B2 9/2003 Rider
6,615,018 B2 9/2003 Funato
6,621,576 B2 9/2003 Tandon et al.
6,626,110 B1 9/2003 Keller
6,633,382 B2 10/2003 Hubble, III et al.
6,639,669 B2 10/2003 Hubble, III et al.
6,650,863 B2 11/2003 Fuma
6,654,136 B2 11/2003 Shimada
6,661,993 B2 12/2003 Bartscher et al.
6,725,010 B1 4/2004 Parker
6,744,527 B1 6/2004 Dorsey et al.
6,757,514 B2 6/2004 Berkes
6,795,661 B2 9/2004 Kanesawa et al.
6,799,003 B2 * 9/2004 Kishimoto et al. ..... 399/328 X
6,819,906 B1 11/2004 Herrmann et al.
6,895,191 B2 5/2005 Rommelmann et al.
6,925,283 B1 8/2005 Mandel et al.
6,973,286 B2 12/2005 Mandel et al.
6,980,762 B2 12/2005 Bogoshian
6,985,691 B2 1/2006 Kodera et al.
7,072,610 B2 7/2006 Nakane
7,197,271 B2 * 3/2007 Nakamura et al. ..... 399/341
7,226,158 B2 6/2007 Moore et al.
2002/0078012 A1 6/2002 Ryan et al.
2002/0103559 A1 8/2002 Gartstein
2002/0191992 A1 12/2002 Funato
2003/0077095 A1 4/2003 Conrow
2003/0180063 A1 9/2003 Kanesawa et al.
2004/0081489 A1 4/2004 Noya et al.
2004/0085561 A1 5/2004 Fromherz
2004/0085562 A1 5/2004 Fromherz
2004/0088207 A1 5/2004 Fromherz
2004/0096250 A1 5/2004 Kito et al.
2004/0114976 A1 6/2004 Weber et al.
2004/0150156 A1 8/2004 Fromherz et al.
2004/0150158 A1 8/2004 Biegelsen et al.
2004/0153983 A1 8/2004 McMillan
2004/0179201 A1 9/2004 Schneider et al.
2004/0216002 A1 10/2004 Fromherz et al.
2004/0225391 A1 11/2004 Fromherz et al.
2004/0225394 A1 11/2004 Fromherz et al.
2004/0247365 A1 12/2004 Lofthus et al.
2005/0025540 A1 * 2/2005 Murai et al. ..... 399/341
2005/0135847 A1 6/2005 Bogoshian
2005/0158089 A1 7/2005 Amarakoon
2006/0034631 A1 2/2006 Lofthus et al.
2006/0067757 A1 3/2006 Anderson et al.
2006/0114313 A1 6/2006 Moore
2006/0115305 A1 6/2006 Lofthus
2006/0115306 A1 6/2006 Lofthus et al.
2006/0221362 A1 10/2006 Julien
2006/0290760 A1 12/2006 German et al.
2007/0071465 A1 3/2007 Hamby et al.

OTHER PUBLICATIONS

Desmond Fretz, "Cluster Printing Solution Announced", Today at Xerox (TAX), No. 1129, Aug. 3, 2001.
U.S. Appl. No. 10/761,522, filed Jan. 21, 2004, Mandel et al.
U.S. Appl. No. 10/785,211, filed Feb. 24, 2004, Lofthus et al.
U.S. Appl. No. 10/881,619, filed Jun. 30, 2004, Bobrow.
U.S. Appl. No. 10/917,676, filed Aug. 13, 2004, Lofthus et al.
U.S. Appl. No. 10/917,768, filed Aug. 13, 2004, Lofthus et al.
U.S. Appl. No. 10/924,106, filed Aug. 23, 2004, Lofthus et al.
U.S. Appl. No. 10/924,113, filed Aug. 23, 2004, deJong et al.
U.S. Appl. No. 10/924,458, filed Aug. 23, 2004, Lofthus et al.
U.S. Appl. No. 10/924,459, filed Aug. 23, 2004, Mandel et al.
U.S. Appl. No. 10/933,556, filed Sep. 3, 2004, Spencer et al.
U.S. Appl. No. 10/953,953, filed Sep. 29, 2004, Radulski et al.
U.S. Appl. No. 10/999,326, filed Nov. 30, 2004, Grace et al.
U.S. Appl. No. 10/999,450, filed Nov. 30, 2004, Lofthus et al.
U.S. Appl. No. 11/000,158, filed Nov. 30, 2004, Roof.
U.S. Appl. No. 11/000,168, filed Nov. 30, 2004, Biegelsen et al.
U.S. Appl. No. 11/000,258, filed Nov. 30, 2004, Roof.
U.S. Appl. No. 11/001,890, filed Dec. 2, 2004, Lofthus et al.
U.S. Appl. No. 11/051,817, filed Feb. 4, 2005, Moore et al.
U.S. Appl. No. 11/070,681, filed Mar. 2, 2005, Viturro et al.
U.S. Appl. No. 11/081,473, filed Mar. 16, 2005, Moore.
U.S. Appl. No. 11/069,020, filed Feb. 28, 2005, Lofthus et al.
U.S. Appl. No. 11/089,854, filed Mar. 25, 2005, Clark et al.
U.S. Appl. No. 11/090,498, filed Mar. 25, 2005, Clark.
U.S. Appl. No. 11/090,502, filed Mar. 25, 2005, Mongeon.
U.S. Appl. No. 11/095,378, filed Mar. 31, 2005, Moore et al.
U.S. Appl. No. 11/094,998, filed Mar. 31, 2005, Moore et al.
U.S. Appl. No. 11/094,864, filed Mar. 31, 2005, de Jong et al.
U.S. Appl. No. 11/095,872, filed Mar. 31, 2005, Julien et al.
U.S. Appl. No. 11/102,355, filed Apr. 8, 2005, Fromherz et al.
U.S. Appl. No. 11/084,280, filed Mar. 18, 2005, Mizes.
U.S. Appl. No. 11/109,566, filed Apr. 19, 2005, Mandel et al.
U.S. Appl. No. 11/109,558, filed Apr. 19, 2005, Furst et al.
U.S. Appl. No. 11/109,996, filed Apr. 20, 2005, Mongeon et al.
U.S. Appl. No. 11/093,229, filed Mar. 29, 2005, Julien.
U.S. Appl. No. 11/102,899, filed Apr. 8, 2005, Crawford et al.
U.S. Appl. No. 11/102,910, filed Apr. 8, 2005, Crawford et al.
U.S. Appl. No. 11/115,766, filed Apr. 27, 2005, Grace.
U.S. Appl. No. 11/102,332, filed Apr. 8, 2005, Hindi et al.
U.S. Appl. No. 11/136,959, filed May 25, 2005, German et al.

U.S. Appl. No. 11/136,821, filed May 25, 2005, Robinson.
U.S. Appl. No. 11/122,420, filed May 5, 2005, Richards.
U.S. Appl. No. 11/137,634, filed May 25, 2005, Lofthus et al.
U.S. Appl. No. 11/137,251, filed May 25, 2005, Lofthus et al.
U.S. Appl. No. 11/137,273, filed May 25, 2005, Anderson et al.
U.S. Appl. No. 11/152,275, filed Jun. 14, 2005, Roof et al.
U.S. Appl. No. 11/156,778, filed Jun. 20, 2005, Swift.
U.S. Appl. No. 11/157,598, filed Jun. 21, 2005, Frankel.
U.S. Appl. No. 11/143,818, filed Jun. 2, 2005, Dalal et al.
U.S. Appl. No. 11/146,665, filed Jun. 7, 2005, Mongeon.
U.S. Appl. No. 11/166,299, filed Jun. 24, 2005, Moore.
U.S. Appl. No. 11/166,460, filed Jun. 24, 2005, Roof et al.
U.S. Appl. No. 11/166,581, filed Jun. 24, 2005, Lang et al.
U.S. Appl. No. 11/166,763, filed Jun. 24, 2005, Thayer.
U.S. Appl. No. 11/166,961, filed Jun. 24, 2005, Moore.
U.S. Appl. No. 11/170,873, filed Jun. 30, 2005, Klassen.
U.S. Appl. No. 11/170,975, filed Jun. 30, 2005, Klassen.
U.S. Appl. No. 11/168,152, filed Jun. 28, 2005, German et al.
U.S. Appl. No. 11/170,845, filed Jun. 30, 2005, Sampath et al.
U.S. Appl. No. 11/189,371, filed Jul. 26, 2005, Moore et al.
U.S. Appl. No. 11/212,367, filed Aug. 26, 2005, Anderson et al.
U.S. Appl. No. 11/208,871, filed Aug. 22, 2005, Dalal et al.

* cited by examiner

PRINTING SYSTEM

This application claims the benefit of the following, now abandoned, U.S. applications, the disclosures of which are incorporated herein in their entireties, by reference: U.S. Provisional Application Ser. No. 60/631,918, filed Nov. 30, 2004, entitled "PRINTING SYSTEM WITH MULTIPLE OPERATIONS FOR FINAL APPEARANCE AND PERMANENCE," by David G. Anderson et al., and U.S. Provisional Application Ser. No. 60/631,921, filed Nov. 30, 2004, entitled "PRINTING SYSTEM WITH MULTIPLE OPERATIONS FOR FINAL APPEARANCE AND PERMANENCE," by David G. Anderson et al.

CROSS-REFERENCE TO RELATED APPLICATIONS

The following applications, the disclosures of each being totally incorporated herein by reference, are mentioned:

U.S. application Ser. No. 10/761,522, filed Jan. 21, 2004, entitled "HIGH RATE PRINT MERGING AND FINISHING SYSTEM FOR PARALLEL PRINTING," by Barry P. Mandel, et al.;

U.S. application Ser. No. 10/924,106, filed Aug. 23, 2004, entitled "PRINTING SYSTEM WITH HORIZONTAL HIGHWAY AND SINGLE PASS DUPLEX," by Lofthus, et al.;

U.S. application Ser. No. 10/924,458, filed Aug. 23, 2004, entitled "PRINT SEQUENCE SCHEDULING FOR RELIABILITY," by Robert M. Lofthus, et al.;

U.S. application Ser. No. 10/953,953, filed Sep. 29, 2004, entitled "CUSTOMIZED SET POINT CONTROL FOR OUTPUT STABILITY IN A TIPP ARCHITECTURE," by Charles A. Radulski et al.;

U.S. application Ser. No. 10/999,450, filed Nov. 30, 2004, entitled "ADDRESSABLE FUSING FOR AN INTEGRATED PRINTING SYSTEM," by Robert M. Lofthus, et al.;

U.S. application Ser. No. 11/000,158, filed Nov. 30, 2004, entitled "GLOSSING SYSTEM FOR USE IN A TIPP ARCHITECTURE," by Bryan J. Roof;

U.S. application Ser. No. 11/000,168, filed Nov. 30, 2004, entitled "ADDRESSABLE FUSING AND HEATING METHODS AND APPARATUS," by David K. Biegelsen, et al.;

U.S. application Ser. No. 11/000,258, filed Nov. 30, 2004, entitled "GLOSSING SYSTEM FOR USE IN A TIPP ARCHITECTURE," by Bryan J. Roof;

U.S. application Ser. No. 11/090,502, filed Mar. 25, 2005, entitled IMAGE QUALITY CONTROL METHOD AND APPARATUS FOR MULTIPLE MARKING ENGINE SYSTEMS," by Michael C. Mongeon;

U.S. application Ser. No. 11/095,872, filed Mar. 31, 2005, entitled "PRINTING SYSTEM," by Paul C. Julien;

U.S. application Ser. No. 11/094,864, filed Mar. 31, 2005, entitled "PRINTING SYSTEM," by Jeremy C. deJong, et al.;

U.S. application Ser. No. 11/137,251, filed May 25, 2005, entitled "SCHEDULING SYSTEM," by Robert M. Lofthus et al.;

U.S. C-I-P application Ser. No. 11/137,273, filed May 25, 2005, entitled "PRINTING SYSTEM," by David G. Anderson et al.;

U.S. application Ser. No. 11/166,460, filed Jun. 24, 2005, entitled "GLOSSING SUBSYSTEM FOR A PRINTING DEVICE," by Bryan J. Roof et al.;

U.S. application Ser. No. 11/168,152, filed Jun. 28, 2005, entitled "ADDRESSABLE IRRADIATION OF IMAGES," by Kristine A. German et al.;

U.S. application Ser. No. 11/189,371, filed Jul. 26, 2005, entitled "PRINTING SYSTEM," by Steven R. Moore et al.;

U.S. application Ser. No. 11/212,367, filed Aug. 26, 2005, entitled "PRINTING SYSTEM," by David G. Anderson, et al., and claiming priority to U.S. Provisional Application Ser. No. 60/631,651, filed Nov. 30, 2004, entitled "TIGHTLY INTEGRATED PARALLEL PRINTING ARCHITECTURE MAKING USE OF COMBINED COLOR AND MONOCHROME ENGINES"; and U.S. application Ser. No. 11/236,099, filed contemporaneously herewith, entitled "PRINTING SYSTEM," by David G. Anderson, et al.

BACKGROUND

The present exemplary embodiment relates generally to a fusing system for a printing system which includes one or more marking devices. It finds particular application in conjunction with a printing system which includes first and second marking devices and a secondary fusing module which enables desired final appearance or permanence characteristics to be achieved as well as maintaining uniform gloss characteristics between printed images generated by the marking devices, and will be described with particular reference thereto. However, it is to be appreciated that the present exemplary embodiment is also amenable to other like applications.

In a typical xerographic marking device, such as a copier or printer, a photoconductive insulating member is charged to a uniform potential and thereafter exposed to a light image of an original document to be reproduced. The exposure discharges the photoconductive insulating surface in exposed or background areas and creates an electrostatic latent image on the member, which corresponds to the image areas contained within the document. Subsequently, the electrostatic latent image on the photoconductive insulating surface is made visible by developing the image with a developing material. Generally, the developing material comprises toner particles adhering triboelectrically to carrier granules.

The developed image is subsequently transferred to a print medium, such as a sheet of paper. The fusing of the toner onto paper is generally accomplished by applying heat to the toner with a heated roller and application of pressure. In multi-color printing, successive latent images corresponding to different colors are recorded on the photoconductive surface and developed with toner of a complementary color. The single color toner images are successively transferred to the copy paper to create a multi-layered toner image on the paper. The multi-layered toner image is permanently affixed to the copy paper in the fusing process.

Another approach employed to fuse toner to paper is to apply a high-intensity flash lamp to the toner and paper in a process known as "flash fusing."

The fusing process serves two functions, namely to attach the image permanently to the sheet (fixing) and to achieve a desired level of gloss.

The reliability of color fusers tends to be low when compared with the other components of a printing machine and with black and white fusers. This is primarily because higher temperatures and longer nip dwell times are typically employed to achieve higher gloss levels for color images. To achieve a high gloss at reasonable temperatures, the surface smoothness (Ra) is generally about 0.4 microns or less. Over time, the color fuser roll tends to wear, resulting in non-uniformities in the surface of the roll, which, in turn, lead to gloss non-uniformities. Additionally, the lifetime of the fuser roll material is limited by the desire to provide compressibility to achieve an adequate nip width, which affects the dwell time for heating, and provide sufficient differential speeds to enable stripping and release.

Systems which incorporate several marking engines have been developed. These systems enable high overall outputs to be achieved by printing portions of the same document on multiple marking devices. Such systems are commonly referred to as "tandem engine" printers, "parallel" printers, or "cluster printing" (in which an electronic print job may be split up for distributed higher productivity printing by different printers, such as separate printing of the color and monochrome pages). In some systems, a process known as "tandem duplex printing" is employed. In this process, a first marking engine applies an image to a first side of a sheet and a second marking engine applies an image to a second side of the sheet. Each of the marking engines is thus operating in a simplex mode to generate a duplex print. This has been found to be more efficient for some applications than using a single marking engine with an internal duplex path to create a duplex print. In some of such printing systems, certain distinct subsystems of the machine are bundled together into modules which can be readily removed from the machine and replaced with new modules of the same type. A modular design facilitates a greater flexibility in the operation and maintenance of the machine.

As xerographic marking devices are now used for a variety of different applications, the requirement for printing on media of varying substrate weight and surface roughness has increased. Coated stock is widely used in the graphics art industry, which increasingly relies on xerographic marking devices.

However, current xerographic marking devices are generally optimized for a particular type of paper and thus may be unable to fuse other substrates without a significant slowing in productivity. Fusing tends to impart curl to the paper, which can cause paper jams downstream of the fuser. Additionally, paper jams and printer damage can occur when the paper finish is not fully compatible with the fusing process.

Integrated parallel printing systems have multiple fusers so the generally low reliability of color fusers has a significant impact on overall reliability. Additionally, maintaining gloss uniformity between the outputs of two or more marking devices is desirable. Deviations in gloss from one marking device to another exist due to tolerances in manufacturing, fuser conditions and components.

INCORPORATION BY REFERENCE

Application US 2005/0135847, published on Jun. 23, 2005, entitled "MODULAR MULTI-STAGE FUSING SYSTEM," by Bogoshian, discloses a secondary fuser which is designed specifically for heavier weight substrates. The Bogoshian application is incorporated herein in its entirety, by reference.

BRIEF DESCRIPTION

Aspects of the present disclosure in embodiments thereof include a printing system and a method of printing. In one aspect, a printing system includes first and second marking devices for applying images to print media. A primary fusing device is associated with each of the first and second marking devices for applying a primary fusing treatment to the images applied to print media by the first and second marking devices. A secondary fusing module receives printed media from the first and second marking devices. The secondary fusing module including first and second secondary fusing devices which selectively apply a further fusing treatment to the images applied to the printed media.

In another aspect, a xerographic system includes a plurality of marking devices for applying images to print media. A primary fusing device is associated with each of the marking devices for applying a primary fusing treatment to the applied images exiting the marking devices. A plurality of secondary fusing devices each selectively receive printed media from the marking devices and apply a further fusing treatment to the applied images thereon. A print media conveyor conveys print media between the marking devices and the secondary fusing devices. A control system controls operations of the printing system. The control system includes a paper path controller which selectively directs print media from at least one of the plurality of marking devices to at least one selected secondary fusing device from the plurality of secondary fusing devices for achieving a predefined fusing characteristic.

In another aspect, a method of printing includes applying images to print media. A primary fusing treatment is applied to the applied images to form printed media. A secondary fusing treatment selected from a plurality of secondary fusing treatments is applied to at least a portion of the printed media to modify an appearance level of the at least a portion of the printed media.

DETAILED DESCRIPTION

Figure 1:
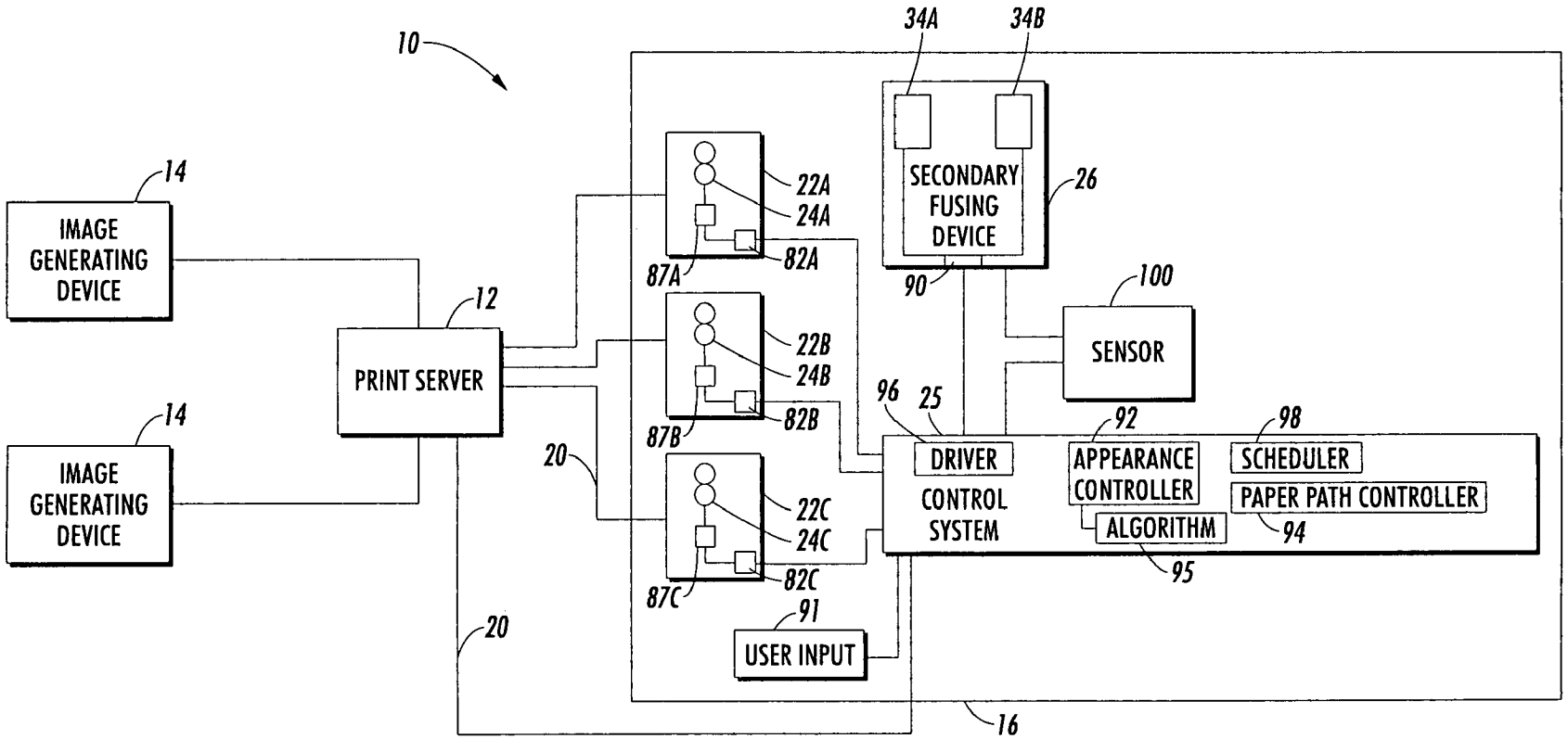
FIG. 1 is a schematic view of an exemplary printing system incorporating a secondary fusing device.

A printing system is disclosed which includes one or a plurality of marking devices which supply printed media, such as sheets, to a common secondary fusing module. A marking device, as used herein, may encompass any device for applying an image to print media. Print medium may encompass a usually flimsy physical sheet of paper, plastic, or other suitable physical print media substrate for images, whether precut or web fed. In one embodiment, the common secondary fusing module augments the fusing performance of primary fusing devices resident in the marking devices. In another embodiment, the secondary fusing module includes at least two secondary fusing devices, each of which is capable of receiving printed media from two or more marking devices. The marking device(s) and secondary fusing device(s) may be under the control of a common control system for printing images from a common electronic print job stream. The printing system generates a print job or document, which is normally a set of related sheets, usually one or more collated copy sets copied from a set of original print job sheets or electronic document page images, from a particular user, or otherwise related.

The extent to which an image is fused is generally a function of energy applied (typically in the form of heat), pressure applied, and dwell time (the time period during which the energy and/or pressure is applied). Fusing may incorporate both fixing (an attachment of the image to the print media) and appearance modification (primarily, modification of a gloss value of the printed media). In a fusing treatment, either one or both of fixing and appearance modification may be effected.

Each of the marking devices includes an image forming component capable of forming an image on print media. A primary fusing device receives the imaged media from the image forming component and fixes the toner image transferred to the surface of the print media substrate, for example, by applying one or more of energy, such as heat via conduction, convection, and/or radiation, and/or other forms of electromagnetic radiation, pressure, electrostatic charges, and sound waves, to form a copy or print. The toner is imaged and if not totally fused, at least tacked to the media in the separate marking devices. The marking devices can then feed the imaged media to the secondary fusing device for any final fusing and gloss enhancement.

The printing system may incorporate "tandem engine" printers, "parallel" printers, "cluster printing," "output merger," or "interposer" systems, and the like, as disclosed, for example, in U.S. Pat. Nos. 4,579,446; 4,587,532; 5,489,969 5,568,246; 5,570,172; 5,596,416; 5,995,721; 6,554,276, 6,654,136; 6,607,320, and in above-mentioned application Ser. Nos. 10/924,459 and 10/917,768. The disclosures of all of these patents and applications are incorporated herein in their entireties by reference. A parallel printing system generally enables portions of a print job to be distributed among a plurality of marking engines, which may be horizontally and/or vertically stacked. A tandem printing system generally allows media which has been printed by one marking device to be printed by a second marking device in the printing system. Printed media from the various marking devices in a parallel and/or tandem printing system may then be conveyed to a common finisher where the sheets associated with a single print job are assembled.

Exemplary fusing systems which may be employed as a primary and/or secondary fusing device are described, for example, in U.S. Pat. Nos. 5,296,904; 5,848,331; 6,487,388; 6,725,010; and 6,757,514; the disclosures of which are incorporated herein in their entireties, by reference.

With reference to FIG. 1, an exemplary printing system 10 is shown. The printing system executes print jobs. Print job execution may include printing selected text, line graphics, images, machine ink character recognition (MICR) notation, or so forth on front, back, or front and back sides, or pages, of one or more sheets of paper or other print media. In general, some sheets may be left completely blank. Other sheets may have mixed color and black-and-white printing. Execution of the print job may also involve collating the sheets in a certain order. Still further, the print job may include folding, stapling, punching holes into, or otherwise physically manipulating or binding the sheets. The printing, finishing, paper handing, and other processing operations that can be executed by the printing system are determined by the capabilities of the printing system.

As illustrated in FIG. 1, the printing system includes a print server or other input device 12 for receiving images to be printed. The print server 12 may receive image data from an individual computer, digital network, built-in optical scanner, digital camera, optical disk, or other image generating device or source of digital images 14. The digital network can be a local area network, such as a wired Ethernet, a wireless local area network (WLAN), the Internet, some combination thereof, or the like. The printing system 10 further includes a printing assembly 16 capable of printing onto a print medium in communication with the print server. The image generating devices, print server, and printing assembly or components thereof may all be interconnected by one or more links 20. The links 20 can be a wired or wireless link or other component capable of supplying electronic data to and/or from the connected elements. Exemplary links include telephone lines, computer cables, ISDN lines, and the like.

The printing assembly 16 includes at least one and in one embodiment, a plurality of marking devices 22A, 22B, and 22C, each with an integral or associated primary fusing device 24A, 24B, and 24C. Each of the marking devices may be under the control of an overall control system 25. While the marking devices are exemplified, in the illustrated embodiment, by three marking devices 22A, 22B, and 22C, each with a respective primary fusing device 24A, 24B, and 24C, it will be appreciated that fewer or more than three marking devices may be employed, such as one, two, four, five, or six marking devices. The printing assembly 16 also includes at least one secondary fusing module 26 which may serve as a final appearance and permanence (FAP) module for modification of appearance and/or permanence characteristics of the media which has been printed and fused by the marking engines.

The printing assembly may incorporate, in addition to a plurality of marking devices, other components, such as finishers, paper feeders, and the like and encompasses copiers and multifunction machines, as well as assemblies used for printing. The printing system may be in the form of an electrophotographic printing apparatus such as a digital copier or printer or combined copier/printer. Exemplary systems include light-lens copiers, digital printers, facsimile machines, and multifunction devices, and can create images electrostatographically, by ink-jet, hot-melt, or by another suitable method.

Figure 2:
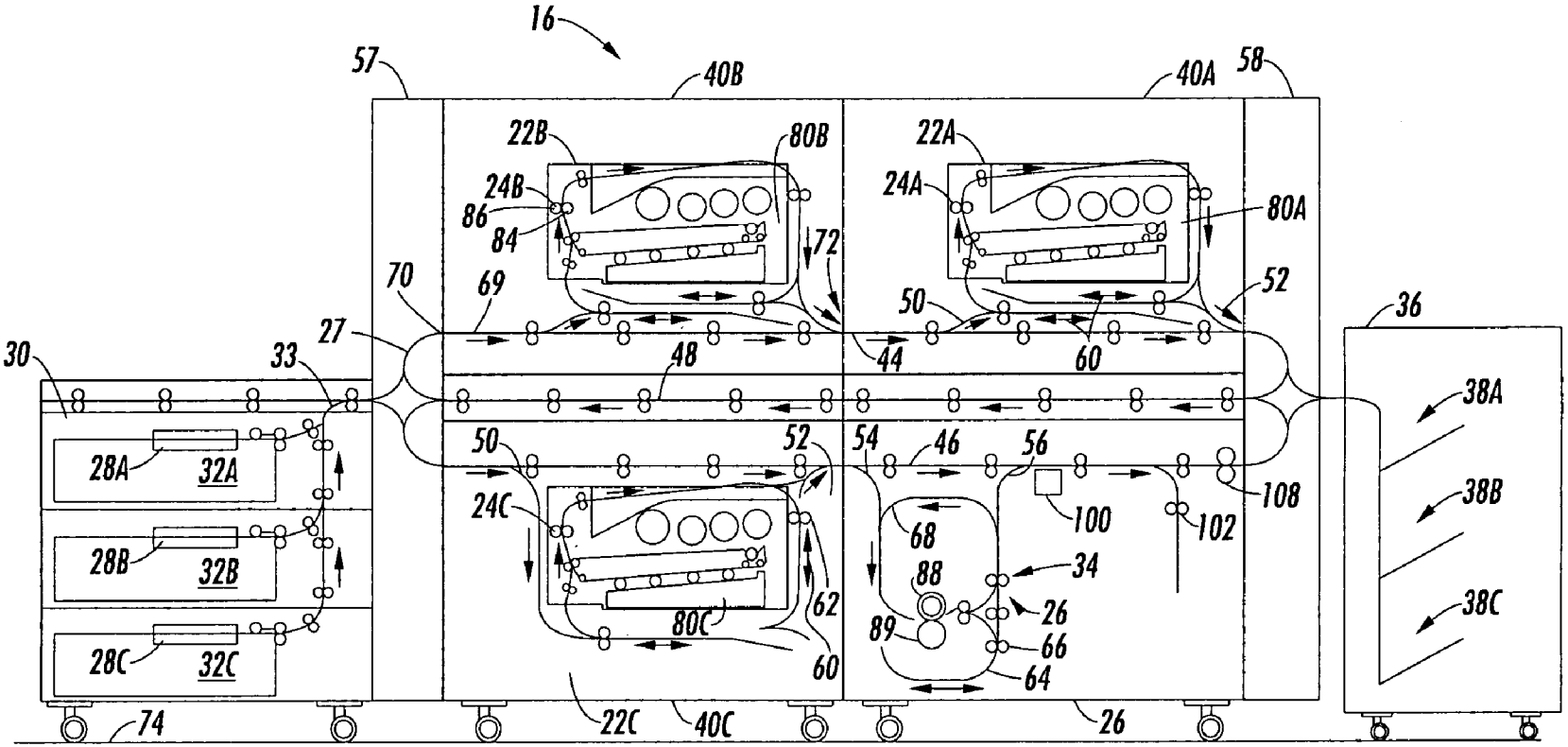
FIG. 2 is a schematic view of a first embodiment of a printing assembly for the printing system of FIG. 1.

With reference now to FIG. 2, the printing assembly 16 may include several identical or different parallel marking devices 22A, 22B, and 22C connected through a print media conveyor system 27, such as a network of flexible paper pathways, that feeds to and collects from each of the marking devices. The conveyor 27 may comprise drive members (not illustrated), such as pairs of rollers, spherical nips, air jets, or the like and associated motors for the drive members, belts, guide rods, frames, etc. (not shown), which, in combination with the drive members, serve to convey the print media along selected pathways at selected speeds. A plurality of nip drive rollers associated with process direction drive motors (not shown), position sensors (not shown) and their associated control assemblies (belts, guide rods, frames, etc., also not shown). In the illustrated embodiment, some of the pathways are in the form of loops, which include downstream and upstream portions, by which the marking devices can be accessed, in any order, by the print media. However, other architectures are also contemplated.

Suitable marking devices 22A, 22B, and 22C include electrophotographic printers, ink-jet printers, including solid ink printers, and other devices capable of marking an image on a substrate. The marking devices may be of the same modality or of different print modalities. Exemplary print modalities include monochrome print modalities, such as black (K), custom color (C), and magnetic ink character recognition (MICR) (M), and multi-color print modalities, such as process color (P). In the illustrated embodiment, marking devices 22A and 22B print black, while marking device 22C may print with in a different marking modality, such as process color. Marking devices may be capable of generating more than one type of print modality, for example, black and process color (CMYK). The marking devices are operatively connected for printing images from a common print job stream. At any one time, a plurality of the marking devices can each be printing. More than one of the marking devices can be employed in printing a single print job. More than one print job can be in the course of printing at any one time. By way of example, a single print job may use one or more marking devices of a first modality (such as black only) and/or one or more marking devices of a second modality (such as process color or custom color). Print media may be printed using two or more marking devices of different modalities or by two or more marking devices of the same modality. The marking devices 22A, 22B, and 22C all communicate with the network print server 12 (FIG. 1), either directly, as shown, and/or via the common control system 25. It will be appreciated that the printing system 10 may include fewer or more marking devices, depending on the anticipated print volume.

With continued reference to FIG. 2, the marking devices may be fed by the conveyor system with print media 28A, 28B, and 28C from a single high speed and capacity feeder module 30. The module 30 may include a plurality of print media sources 32A, 32B, 32C in the form of trays, although it will be appreciated that one or more of the marking devices may alternatively or additionally be fed from one or more separate feeders. The print media may be transported by the conveyor 27 to the marking devices along a pathway 33 which is common to a plurality of the trays 32. The print media sources 32A, 32B, 32C may be loaded with print media 28A, 28B, 28C of different types. Each document feeder tray 32A, 32B, 32C may include print media having different attributes such as roughness, coats, weights and the like. For example, source 32A supplies paper sheets of one surface finish or weight, while another 32B supplies paper sheets of a different surface finish or weight. The surface finishes may be selected to allow the printed sheets to achieve different selected levels of gloss. For example, the sheets in one of the sources may be treated with a coating or calendered, which allows a high level of gloss. The different surface finishes may benefit from different fusing treatments to permanently affix an image to the media and/or achieve a selected level of gloss.

The secondary fusing module 26 is placed apart from all of the marking devices 22A, 22B, 22C and includes at least one secondary fusing device 34, such as one, two, three or four secondary fusing devices. An output device, such as a finisher 36 with one or more separate finishing capabilities, here represented by output trays 38A, 38B, 38C, receives printed media from the secondary fusing module 26 and/or any one of the clustered marking devices 22A, 22B, 22C. While secondary fusing device is shown as being housed in a separate module 26 from the marking devices, it will be appreciated that the secondary fuser 34 may be located in any convenient location which is accessible to the marking devices.

One or more of the marking devices 22A, 22B, 22C, feeder module 30, and finisher 36 can be in the form of interchangeable and/or replaceable modules. For example, each of the marking devices is housed in a separate printer module 40A, 40B, 40C, which carries a portion of the conveyor system 27. The lower modules may be carried on wheels. Similarly, the secondary fusing module 26 can also carry a portion of the conveyor system 27 and be linked thereby with the finisher 36. In this way, the various modules 22A, 22B, 22C, and 34, can be removed from the printing system for repair and/or replacement while leaving the main highways of the conveyor system intact and the printing system at least partially functional. Other arrangements for connecting the respective marking devices with the secondary fusing device 34 and finisher 36 are also contemplated.

The illustrated conveyor system 27 is configured for transporting printed media from each of the marking devices 22A, 22B, 22C to the secondary fusing module 26, while allowing selected ones of the printed media to bypass the secondary fusing module 26. The illustrated conveyor system 27 includes two downstream print media highways 44, 46, located intermediate the feeder module 30 and the finisher module 36, and one or more upstream highways 48, which travel in a generally opposite direction to the downstream highway, allowing print media to travel between a downstream and an upstream marking device. For each marking device, pathways 50, 52 for marking device 22C and similar pathways for the other marking devices, feed the print media between the media highways 44, 46 and the marking device, allowing print media to be directed from the media highways to an from selected ones of the marking devices. Pathways 54 and 56 within the secondary fusing module 26 feed the printed media to and from the secondary fusing device 34. Upstream and downstream endcap modules 57 and 58, respectively include pathways of the media handling system 27 which connect the highways 44, 46, 48 at ends thereof such that the output of any marking device can be directed to any marking device (e.g., to another marking device), to the secondary fusing module 26, and/or to the finisher 36. For example, the printed media outputs of one marking device 22B can bypass a second marking device 22A via horizontal highway 44 for simplex printing. Alternatively, where a document is to be tandem duplex printed, or printed on the same side by two marking devices, the highway 44 transports the printed media from a first marking device 22B to a second marking device, e.g., marking device 22A for the second printing. The details of simplex printing and duplex printing through marking devices arranged in tandem are known and can be generally appreciated with reference to the foregoing cited U.S. Pat. No. 5,568,246, incorporated by reference. Alternatively or additionally, one or more of the marking devices 22A, 22B, 22C may include an internal duplex path for creating a duplex print internally. However, tandem duplex printing (i.e., each marking device printing in a simplex mode) is generally advantageous for reliability of paper handling and for simplifying system jam clearance.

The highways 44, 46 and/or pathways 50, 52, 54, and 56 may include inverters, reverters, interposers, bypass pathways, and the like as known in the art to direct the print substrate between a highway and a selected marking device or between two marking devices. For example, each marking device is provided with inversion pathways 60, each including an inverter 62, to enable a print substrate which has already been printed on one side to be inverted prior to printing on the other side by the same or by a different marking device. The inverters may also serve as velocity buffers between high speed highways and the marking devices. In this system, the inverters may also optionally include registration capability.

It will be appreciated that irrespective of whether the marking devices are configured for duplex or simplex printing, an image may be fused only once, or two or more times by the same or different fusers before reaching the secondary fuser module 26. As a result, images which have been fused only once by one fuser may reach the secondary fusing module 26 with a different appearance (e.g., gloss) and/or level of fix than images which have been fused once by another fuser, due to variations between the two fusers. Moreover, images which have been fused only once may differ in appearance and fixing characteristics from images fused two or more times, since each time an image passes through a fuser, further fusing may occur, even if the image is on the side of the sheet furthest from the fusing elements. Further, those images which have been fused two or more times may also exhibit variations due to differences between the individual fusers and whether the image was fused directly, by being on the side of a sheet closest to the heat source, or indirectly by being on the opposed side of a sheet. The secondary fusing module 26 enables differences in appearance and or level of fix among images of a print job to be reduced by selectively applying a secondary fusing treatment to some or all of the images in the print job and optionally by applying a first secondary fusing treatment to a first group of the images and a second, different secondary fusing treatment to a second group of the images.

The illustrated secondary fusing device 34 can function as a simplex or duplex device, fusing either one or both sides of the print media. In one embodiment, an inversion pathway 64 includes an inverter 66 which allows printed media to be inverted after passing through the secondary fusing device 34. A return loop 68 returns the print media to the secondary fusing device 34 for fusing on the second side or for fusing an image two or more times.

As shown in FIG. 2, each printer module 40A, 40B, 40C supports a portion 69 of a downstream print media highway 44, 46 with an input 70 and an output 72, which may be arranged at the same height above a support surface 74, as the input and output of one or more adjacent modules for ease of interconnection of the print highway. Alternatively, the modules may be horizontally stacked or otherwise oriented.

Although each of the marking devices 22A, 22B, and 22C is shown linked to the secondary fusing module 26 by the same highway 46, either directly, or indirectly via return highway 48, it is to be appreciated that the marking devices may alternatively be linked by separate pathways to the common secondary fusing module 26.

It will be appreciated that portions of the conveyor system 27 may convey the print media at higher speeds than others. For example, on main highways 44, 46, 48 the print media may be transported at a relatively high speed, and then slowed down before passing through the marking devices. In order to merge the sheets from two or more marking devices together without overlapping them, the sheets are optionally accelerated to a higher velocity.

Each marking device 22A, 22B, 22C includes an image forming component 80A, 80B, 80C, respectively, which is capable of forming an image on the print media, and at least one primary fusing device 24A, 24B, 24C, respectively, which may be integral to the image forming component, or separate therefrom. In electrophotographic printing, as described, for example, in above-mentioned application Ser. No. 11/000,258, the image forming component 80 typically includes a charge retentive surface, such as a rotating photoconductor belt or drum. Disposed at various locations around its circumference are xerographic subsystems, such as a cleaning device, a charging station for each of the colors to be applied, an image input device which forms a latent image on the photoreceptor, and a toner developing station associated with each charging station for developing the latent image formed on the surface of the photoreceptor by applying a toner to obtain a toner image. A pretransfer charging unit, such as a charging corotron, charges the developed latent image. A transferring unit transfers the toner image thus formed to the surface of a print media substrate, such as a sheet of paper. The printed image then proceeds to the primary fusing device 24A, 24B, and 24C. The xerographic subsystems of the marking device may be controlled by a central processing unit (CPU) 82A, 82B, and 82C, respectively, which is in communication with the control system 25.

Each marking device 22A, 22B, 22C can receive image data, typically as discrete pixels, in the form of digital image signals for processing from the image source 14, e.g., computer network, by way of a suitable link 20. Typically, a job is generated by a user of the network. The job includes the image data in the form of a plurality of electronic pages and a set of processing instructions. Each job is converted by the print server or by a processing component of the printing assembly 16 into a representation written in a page description language (PDL) such as PostScript™ containing the image data. Where the PDL of the incoming image data is different from the PDL used by the digital printing system, a suitable conversion unit converts the incoming PDL to the system PDL. Whether digital image data is received from a scanner, a computer network, or other source, an interface unit processes the digital image data in the form required to carry out each programmed job. The interface unit may be part of the print server 12 or located in the printing assembly 16. However, the computer network or the scanner may share the function of converting the digital image data into a form which can be utilized by the digital printing system 10.

Each primary fusing device 24A, 24B, and 24C may be of the type conventionally used with xerographic printers. For example, as illustrated in FIG. 2, the primary fusing device 24A, 24B, and 24C may include a heat applying component 84, such as a heated roller and/or a pressure applying component 86, such as a roller or pair of rollers. The heat applying component and pressure applying component may be adjacent, to define a nip therebetween, as shown, or be spaced along the paper pathway. The heated roller 84 is brought into thermal contact with the imaged media to at least partially melt the toner forming the image. The pressure applying roller 86 or rollers apply pressure to the partially melted image. Each marking device includes an actuator 87A, 87B, 87C, respectively (FIG. 1), which may be associated with the marking engine CPU 82A, 82B, 82C, for adjustment of the respective primary fusing device 24A, 24B. 24C. For example, the actuator adjusts power to the heated roller 84 to vary the roller temperature.

Other primary fusing devices 24A, 24B, and 24C are also contemplated to melt the toner and fuse it with the fibers of the paper or other media. These include non-contacting radiant fusing devices, fusing systems which use intense electromagnetic radiation in the visible or UV portion of the electromagnetic spectrum, such as from a quartz rod, light emitting diodes or laser diodes (both of which will be referred to herein as LEDS).

The secondary fusing device 34 may be similarly configured to the primary fusing device. In the embodiment illustrated in FIG. 2, the secondary fusing device includes a heated roller or gloss roll 88 and a pressure roller 89 which define a nip therebetween. The heated roller 88 is optionally chosen to be a stiff material such as a Teflon™ impregnated ceramic, or the like. The pressure roller 89 is then made to be durable yet conformable and can be formed of a typical pressure roll elastomer material, PFA sleeve over elastomer, or the like. The roller 88 is heated, but since the objective is generally not to cause the toner to flow, lower temperatures than those required for primary fusing can be used. Although the secondary fusing device is primarily responsible for melting only the very top of the toner and changing its surface roughness, some conformance is desirable in order to make contact with all areas of the image. An actuator 90 (FIG. 1), or optionally a plurality of actuators where there is more than one secondary fusing device, allows adjustments to be made to the secondary fusing device 34, for example, adjustment to the power supplied to the heated roller 88 to vary the heated roller temperature. The actuators 87A, 87B, 87C and 90 of the first and secondary fusing devices may be manually or automatically controlled.

The primary fusing device 24A, 24B, and 24C can serve as a blanket fuser, in that it applies a fusing treatment to the entire image formed in the respective image forming component. The primary fusing device 24A, 24B, and 24C performs at least a partial fusing of the image applied by the image forming component 80. By partial fusing, it is meant that the fixing of the image is not up to the desired level for the final printed media and/or the appearance of the image, e.g., gloss level, is not within desired tolerances, over at least a portion of the image. The primary fusing device 24A, 24B, and 24C may thus serve to provide what will be referred to as "in situ permanence," (i.e., sufficient "fix" to at least tack the image to the print media so that the image on the sheet is preserved as the sheet travels throughout the system) while the secondary fusing module 26 is used to generate a desired level of archival permanence and/or final image appearance, for example by modification of the gloss and/or further fixing. In this embodiment, both primary and secondary fusing devices may contribute to the fixation of the image and/or the image quality of at least a portion of the sheets, and/or portions of individual sheets.

To minimize the demands on the integral fusing devices 24A, 24B, and 24C, in one embodiment, sufficient heat (in the case of a fusing device incorporating heat) or other fusing parameter, such as pressure, light, or other electromagnetic radiation, is used to provide in situ permanence. The gloss and/or fix levels of the imaged media exiting the marking device 22A, 22B, 22C, etc. and arriving at the secondary fusing module 26 can thus be lower than that desired for its final appearance/permanence. As a result, reliability and lifetime of the individual marking devices is improved.

Figure 3:
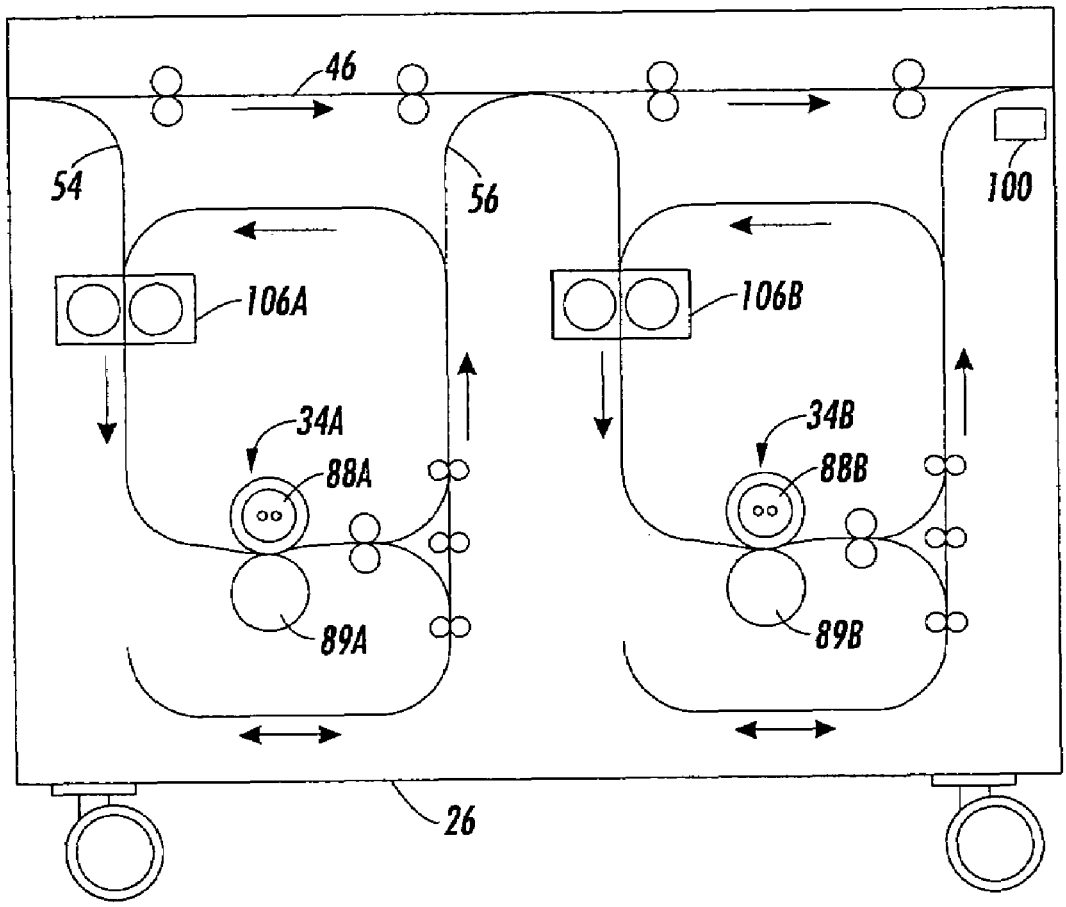
FIG. 3 is a schematic side sectional view of alternative embodiment of a printing assembly for the printing system of FIG. 1.

In one embodiment, the secondary fusing module 26 includes a plurality of secondary fusing devices 34A, 24B as illustrated in FIG. 3, where similar elements are given similar numerals and new elements are given new numerals. Each secondary fusing device may provide the secondary fusing function for a portion of the printed media output. For example, printed media can be selectively directed from the media highway 44 to one or more of the secondary fusing devices 34A, 34B, each of which may be similarly configured to secondary fusing device 34 of FIG. 2. Separation of fixing and final appearance functions allows the final appearance to be controlled by a separate device from that of the permanence function. Multi-pass fusing, in which sheets are routed through the secondary fusing device 34 multiple times, may also be employed in order to achieve a targeted level of permanence and/or appearance.

With reference once more to FIG. 1, the control system 25 may select an appropriate secondary fusing treatment and/or control some or all of the operating parameters of the secondary fusing devices 34, 34A, 34B. In addition to providing control of final appearance and/or fixing, the control system 25 may also control the primary fusing devices 24A, 24B, and 24C, either directly, or indirectly, via each marking engine's CPU 82. The control system 25 may also control other operations of the marking devices 22A, 22B, and 22C via communication with the marking device CPUs, as well as the routing of print media through the system, and may include a user input 91 to allow an operator to selectively control some of the details of a desired print job.

The illustrated control system 25 includes an appearance controller 92 and a paper path controller 94. The paper path controller 94 controls the movement of print media through the system. The paper path controller 94 can be used to route printed media which has been fused by a primary fuser to a selected one of the secondary fusing devices, depending on the desired level of secondary fusing. In the event that one of the marking devices or secondary fusing devices goes off-line or otherwise suffers a failure, the paper path controller can reroute the print media through an alternative marking device/secondary fuser, where one is available.

The appearance controller 92 may access an algorithm 95, such as a look up table, which is input with information that is used in determining whether to employ the secondary fusing module 26 for a particular image or images and/or what secondary fusing treatment to apply. For example, the algorithm 95 may be input, prior to printing, with characteristics of each of the marking devices, such as:

1. The gloss level which is achieved by a particular marking device at a given processing speed, and for a selected print media;
2. The extent to which the marking device provides adequate fixing of the selected print media at the given processing speed;
3. The extent to which one marking device compensates for inadequacies of a prior marking device (where more than one marking device is used for imaging a single sheet);
4. The extent to which different toners and/or paper properties, such as weight, surface finish, and surface roughness of the print media affect the fixing or appearance.

The control system may thus take into account multiple variables in determining a suitable secondary fusing treatment. In this way, the pages of a document can be rendered more similar in their image appearance to the eye and/or satisfy other preselected fusing criteria.

The appearance controller 92 determines whether a secondary fusing is required and, if so, the paper path controller 94 sends the printed media to the secondary fusing device 34 or to a selected one of a plurality of alternative secondary fusing devices. In the case of multiple secondary fusing devices, the appearance controller may determine the appropriate level of secondary fusing to apply to the media to achieve preselected final fusing characteristics, such as appearance (e.g., gloss) and/or permanence (level of fixing), and selects an appropriate secondary fusing device 34 or devices to achieve this.

For any print job, one of several operations may be selected. These operations may include no secondary fusing treatment for a particular print job, secondary fusing treatment for all images in a print job; and secondary fusing treatment for only a portion of the images in the print job, such as that portion of the images exhibiting lower gloss, the remainder of the print job receiving no secondary fusing treatment. For those images where a fusing treatment is to be applied, a further selection from several types of secondary fusing may be made for selected ones or for all of the images, such as a single pass through one secondary fuser, multiple passes through a secondary fuser, a single pass through a selected one of two or more secondary fusing device (where these exist), multiple passes through a selected one of two or more secondary fusing devices, and single or multiple passes through two or more secondary fusing devices.

The appearance controller 92 may also determine whether the desired fusing characteristics are being met. For example, the determination may be based on the selected marking media, the known capabilities of the marking device on which it is marked, and so forth, stored for example, in the algorithm. Alternatively or additionally, the appearance controller may receive information from a sensor, such as an inline sensor 100 or an offline sensor, from which the determination can be made. The appearance controller may then effectuate modifications to the fusing characteristics of the images exiting the secondary fusing devices through communication with the secondary fusing module 26. In one embodiment, a driver 96 of the control system controls the actuator 90 of the secondary fusing device 34 so as to achieve the desired fusing characteristics, for example, by raising or lowering fuser roll temperatures, varying dwell time, or pressure. This may involve an iterative process in which several test sheets are sent to the marking engines, sensed by the sensor and modifications made to the secondary fusing device(s) until the fusing characteristics are met.

The control system 25 includes a job scheduler 98, which schedules the execution of a print job including routing of the selected media 28A, 28B, 28C, throughout the printing system to the various marking devices 22A, 22B, and 22C, printing of each image, and the time of arrival of the printed media at the secondary fusing module 26. In scheduling the print job, the job scheduler may access a model of the machine which includes information such as current states of the components of the printing system, including states of the marking engines and secondary fusing module 26 and/or may query the CPUs 82A, 82B, and 82C of the marking engines to confirm that they will be available for printing an image at a particular future time.

It will be appreciated that all or a portion of the functions of the control system 25, such as those of the scheduler 98, paper path controller 94, and appearance controller 92, may be distributed throughout the printing system and/or incorporated in the print server 12. Additionally, while each of these control functions are shown separately, it is to be appreciated that a single processing component may perform two or more of the functions of the scheduler 98, paper path controller 94, and appearance controller 92.

In the event that the desired final appearance and fixing characteristics fall outside the ranges for these characteristics which the secondary fusing device 34 is capable of providing for the selected media, the control system 25 may instruct the job scheduler 98 to vary the operation schedule of the printing system 16 so that the desired final appearance and fixing characteristics can be achieved. For example, this may be achieved by slowing the processing speed of one or more of the marking devices 22A, 22B, and 22C, using a different marking device, or marking devices, or adjusting the level of blanket fusing (e.g., increasing one or more of heat, pressure and dwell time) provided by the primary fusing devices 24A, 24B, and 24C, such that the primary fusing devices 24A, 24B, and 24C achieve a higher level of fusing.

Where there is more than one secondary fusing device 34, the scheduler 98 may select an appropriate secondary fusing device 34 for achieving the desired final appearance. Alternatively, the sheet may be passed through a secondary fusing device multiple times, and/or the secondary fusing device may be adjusted to achieve the desired final appearance and/or permanence.

The job scheduler 98 takes into account the different speeds of the marking devices, the finishing requirements, and the like in scheduling the print jobs, as described, for example, in U.S. Publication Nos. 2004/0088207, published May 6, 2004, 2004/0085562, published May 6, 2004 and 2004/0085561, published May 6, 2004, all by Fromherz, which are incorporated herein by reference in their entireties. The job scheduler may also determine a route for each sheet of each of the print jobs through the printing assembly.

In the event that a fault occurs in a primary fusing device 24A, 24B, and 24C of one of the marking devices 22A, 22B, and 22C, such that the primary fusing device is performing a lower level of fusing than anticipated, but still enough to tack the image to the media, the control system 25 or print server 12 may recognize that the fusing is incomplete (e.g., based on a communication from the marking device or feedback from a sensor, such as sensor 100) and, if appropriate and can be compensated by a secondary fusing device, instructs the secondary fusing device to compensate for the defect.

The sensor 100 may include an appearance sensor which senses an appearance characteristic of the printed media, such as reflection of light at one or more wavelengths. For example, the appearance sensor can be a gloss meter which measures gloss. Gloss can be determined in a number of ways, for example, specular gloss is the percentage of the intensity of the incident light (at a specified angle of incidence, e.g., at 20, 60, or 85 degrees, and in a specified wavelength range) which is reflected from the surface. The appearance sensor 100 may alternatively or additionally include components for measuring other optical appearance properties, such as a calorimeter, spectrophotometer and/or other components for generating and processing color information.

The appearance sensor 100 may be an inline sensor which is positioned to detect the appearance characteristic of media after all fusing treatments have been applied. Alternatively or additionally, the sensor may be positioned to detect the appearance characteristic after the primary fusing step but prior to secondary fusing step. In one embodiment, the appearance sensor 100 is accessible to all the marking engines and/or to print media at different stages of printing. In FIG. 2, for example, the appearance sensor 100 is positioned adjacent paper path 46 to evaluate the appearance of print media images after primary fusing and optionally after the media has been treated by the secondary fusing device 34. Alternatively, the sensor may be located elsewhere, such as adjacent path 56, in upstream highway 48, or closer to the finisher 36. The appearance sensor may evaluate the appearance characteristic(s) of all printed media or only a portion thereof. In one embodiment, the sensor may be located in a dedicated side path 102, allowing a portion of the printed media to be directed from a main highway 44, 46, 48 into the side path 102 and subsequently discarded. In this way, the sensor 100 has time to undertake a plurality of measurements without impacting the overall processing speed of the printing system.

In another embodiment, the sensor 100 is an offline sensor. The user takes samples of printed media from the printing system to the offline sensor for evaluation. The offline sensor may communicate information such as gloss levels to the control system 25. Or the user may enter appropriate information via the user input 91 which communicates the information to the control system.

In another aspect, the sensor 100 measures a property which is related indirectly to the appearance characteristic. For example, the sensor may detect a surface property of the fuser roll of the primary fusing device, such as smoothness or gloss, which can be related, for example by use of a look up table, to the gloss of the printed media.

The sensor 100 may be linked to the control system 25, which stores information from the sensor in the algorithm 95. Measurements on gloss and/or other fusing characteristics are thus used by the control system to determine appropriate settings for the secondary fusing device 34.

In one embodiment, the sensor 100 is used to precalibrate the control system 25. Periodically, e.g., daily, or after each print run, test sheets are printed and fused by the various marking devices, singly and/or in various combinations. The appearance characteristics of the test sheets are then compared with a set of stored desired appearance characteristics and adjustments to the control algorithm 95 for the secondary fusing module 26 and/or primary fusing devices 24A, 24B, and 24C are made. The stored characteristics may be generated by directing printed media which has been predetermined to meet appearance characteristics to the sensor 100.

In another aspect, the appearance sensor 100 is used to ensure that print characteristics of a print run are being met. Printed media whose appearance is determined to be outside selected appearance tolerances is discarded. Based on the variation of the gloss level from the final appearance characteristics desired, the control system appearance controller 92 accesses the algorithm 95 to determine the appropriate final appearance treatment which is to be applied by the secondary fusing module 26 for subsequent media to bring the appearance characteristics within acceptable tolerances. In this way, adjustments can be made at appropriate times.

In one embodiment, the secondary fusing module 26 applies a fusing treatment, or a different fusing treatment, to a selected portion or portions of a printed sheet, the portion or portions encompassing less than the entire area of the image, as disclosed, for example, in copending application Ser. No. 10/999,450, referenced above. For example, portions of the image, such as text, may be left matte, while other portions, such as those incorporating artwork, may have the level of gloss raised.

In another embodiment, the secondary fusing module 26 may be called upon only in cases where there is a fusing shortfall (fixing, image gloss, image gloss uniformity, productivity) of the primary fusing devices. In this embodiment, the secondary fusing device 26 need not treat all the printed media. For example, the primary fusing devices may have sufficient fusing capability such that full fusing of the images on a particular type of paper, at a selected gloss level and desired level of fixing, and at a given productivity, is achieved without operation of the secondary fusing device. Thus, at some times during printing, the primary fusing devices 24A, 24B, and 24C may have the ability to complete the fusing of the printed images (in terms of both fixing and desired appearance characteristics), without the need for the secondary fusing module 26. In such cases, the secondary fusing device 34 is optionally bypassed and the printed media is directed from the marking device(s) 22A, 22B, and 22C directly to the finishing module 36. At other times, for example, in order to maintain full productivity and/or when the print media substrate to be used or gloss level desired is such that the primary fusing device cannot maintain complete fusing, the primary fusing device of one or more of the marking devices 22A, 22B, and 22C effects a partial fusing, e.g., it at least serves to tack the toner image to the print media in such a fashion as to avoid image disturbance as the sheet is transported by the conveyor system 27 to the secondary fusing device 34, where the fusing process is completed. The secondary fusing device 34 can be designed such that it has fusing latitude to accomplish the specified final image fixing and appearance of the media.

In another embodiment, all of the printed media is directed through the secondary fusing module 26. In this embodiment, the secondary fusing device may apply a fusing treatment to all the media, only to selected sheets of the media, and/or only to selected portions of sheets of the media.

In another embodiment, the secondary fusing module 26 allows a high gloss mode to be specified. In this mode, a gloss level higher than that which can be achieved by an individual marking device at the desired productivity for the particular print media selected is achieved.

In yet another aspect, the printing system 10 may provide for real time or near real time adjustment of the secondary fusing devices 34A, 34B, and optionally also 34C, and 34D, where present. In this embodiment, the sensor 100 provides real-time measurements to the control system 25 which may be stored in the algorithm. The fusing characteristic controller 93 determines appropriate adjustments to make to one or more of the various secondary fusing devices in order to keep final appearance within the predefined target range.

In another aspect, the system 10 enables differences between the fusing characteristics of printed media from two or more marking devices 22A, 22B, and 22C which each print portions of a print job to be reduced. Specifically, the control system 25 evaluates differences in the print characteristics from the two or more marking devices and sends print media from one or both of the marking engines to an appropriate secondary fusing device 34A, 34B, to correct for those differences. The evaluation may include accessing the algorithm 95 which provides appropriate secondary fusing treatments based on which one or more of the primary fusing devices have been used to fuse an image. The control system may use the secondary fusing module to reduce the differences between images which have been fused by different fusing devices or different combinations of fusing devices. For example, one marking device may achieve a higher level of gloss in its outputted printed media than another marking device. The control system receives fusing information, such as the gloss levels, from the sensor, or by other means, such as from a user via the user input 91. Taking the fusing information into consideration, the print job scheduler 98 may schedule a different secondary fusing treatment depending on the fusing characteristics of the images for the low gloss pages than the high gloss pages.

In another aspect, the control system selects an appropriate secondary fusing treatment to compensate for differences between those images which have seen a single primary fusing device and those which have seen two or more primary fusing devices.

In yet another aspect, the control system selects a secondary fusing treatment to compensate for differences in image fusing characteristics which are due to differences in the print media substrates used. For example, where a portion of a print job is printed on a first print media substrate and a second portion of the print job is printed on a second substrate, different from the first, the images printed on the first substrate may have different fusing characteristics from those printed on the second substrate, even in cases where the images are all printed and fused by the same marking engine. The two substrates may differ in terms of one or more of their basis weight, surface coating, surface roughness, and the like. The control system may send the images on one substrate, such as the lower gloss images to the secondary fusing device or, where there are two or more secondary fusing devices, use one secondary fusing device for one substrate and the other secondary fusing device for the other substrate or use combinations of secondary fusing devices to achieve a more consistent fusing characteristic, such as gloss between the different substrates. In one embodiment, the primary fusing devices in the marking devices are responsible for melting and fixing the toner and for achieving the desired amount of micro-conformance needed for uncoated papers and for rougher papers.

In another aspect, the secondary fusing system is used to ensure that all images in a print job, or preselected images in a print job, meet a preselected fusing characteristic, such as a minimum acceptable gloss or fall within an acceptable gloss range.

Optionally, a temperature sensor (not illustrated) measures a temperature of the heated roller 88 or paper exiting therefrom. The temperature sensor may be located adjacent the nip between the rolls of the secondary fusing device and provide feedback control information to the control system 25 which can be used for local control of the secondary fusing device 34A, 34B, such has in making adjustments to the temperature of roller 88.

Since the level of gloss generally increases with the heat applied, it is generally desirable for the level of gloss achieved in the primary fusing device 24A, 24B, and 24C to be below or within the targeted gloss range to be achieved by the secondary fusing module 26. However, under some circumstances, downward modification of gloss can be achieved, for example by supplying sufficient heat that the surface of the image is essentially damaged, or by using an uneven pressure roller, rendering the surface of the image slightly uneven and thus lower in gloss.

In aspects of the exemplary embodiment illustrated in FIG. 3, the secondary fusing module 26 further includes a preheater 106A, 106B, which uniformly heats the print media (or the imaged portion) prior to secondary fusing. In the embodiment of FIG. 3, each secondary fusing device 34A, 34B has its own associated preheater 106A, 106B, although it is also contemplated that a single preheater may be employed for both secondary fusing devices. The preheaters 106A, 106B reduce the heat input required in the secondary fusing devices 34A, 34B. This also facilitates a choice of more robust materials for the gloss roller and conditions for achieving high glossing reliability.

Where the printed media is printed on both sides with an image, both sides can be treated by a secondary fusing device 34, for example by inverting the sheet and repassing the sheet through the secondary fusing device, or by having two secondary fusing devices arranged in series, one for the first side of the sheet, the other for the second side. In another embodiment (not shown), both sides of the sheet are simultaneously treated by the secondary fusing device 34.

Figure 4:
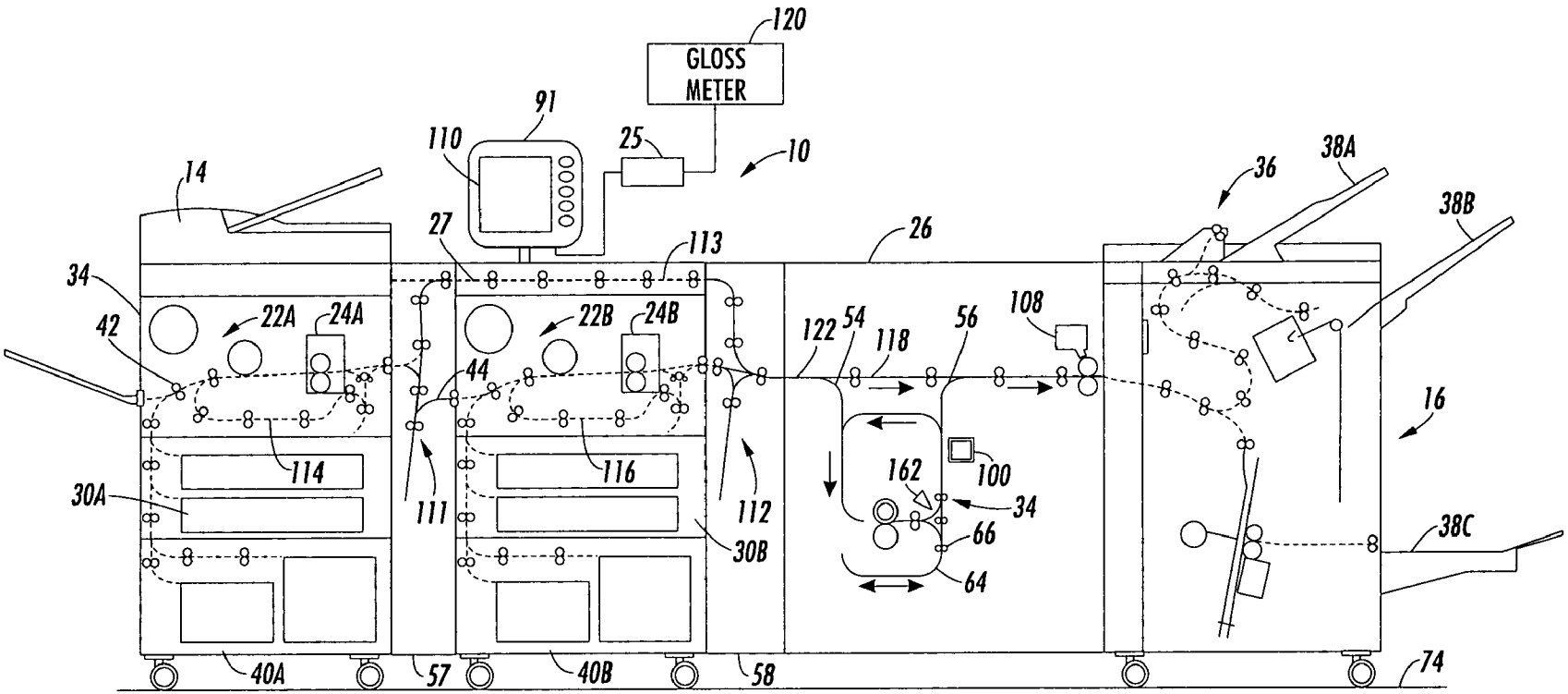
FIG. 4 is a schematic side sectional view of alternative embodiment of a printing assembly for the printing system of FIG. 1.

With reference now to FIG. 4, another embodiment of a printing system is illustrated, where similar elements are accorded the same numerals and new elements are accorded new numerals. The printing system is similar to that of FIG. 2, except as otherwise noted. A scanner 14 serves as an image generating device although the system may alternatively or additionally be linked to other image generating devices, such as those previously described. A control system 25 controls operation of both marking devices, with options for user input and display of ongoing operations via a user interface 91, illustrated as comprising a monitor 110. Tandem marking devices 22A, 22B are connected to each other and to a secondary fusing module 26 by a conveyor system 27. The illustrated conveyor 27 allows print media to travel generally downstream; there is no return pathway for media printed by marking device 22B to return to marking device 22A, although it is to be appreciated that such a pathway could be provided. Endcap modules 57, 58 include inversion pathways 111, 112 and connect a main highway 44, passing through both marking devices, with an overhead bypass pathway 113. The bypass pathway 113 allows print media which has been printed and fused in marking device 22A to bypass marking device 22B. In this embodiment, each marking device has its own paper feed source 30A, 30B, incorporated in modules 40A, 40B, respectively, each comprising various paper trays. The marking devices 22A, 22B have internal duplex paths 114, 116, respectively, which permit printing on a first side of a sheet and on a second side of the sheet by the same marking device, following inversion. The bypass pathway 113 and main highway 44 join in the endcap module 58 and the combined pathway feeds print media to one or more secondary fusing devices 34 of the module 26 which can be similarly configured to that illustrated in FIGS. 2 and 3. A bypass pathway 118 permits the secondary fusing device 34 to be bypassed.

The control system 25 is in communication with the user interface 91. In one embodiment, a user selects a desired gloss level on a control panel on the user interface or allows the user interface to communicate with a remote appearance sensor 120 to obtain a gloss level from a sample of printed media, measured by the remote sensor, which the user desires to replicate.

For example, the sample may be a printed substrate printed on a different printing machine or using a different printing method. The remote appearance sensor 120 also allows the user to view and test the gloss levels of printed test sheets generated by the system 10. Optionally, the tested sheets are returned to the secondary fusing device 34, e.g., via an input 122 to the by-pass pathway 118. In this way, the user can reprocess the test sheet if it does not meet the user requirements for the final printed media output, for example, in order to determine how many times a sheet should pass through the secondary fusing device. In one embodiment, modifications are made to the operating parameters of the secondary fusing device 34 and/or to the primary fusing devices 24A, 24B, or to the routing of the printed media so that future sheets more closely match the desired outputs. Operation parameters, for example, gloss roll temperature, speed of the substrate moving through the gloss roll, and pressure between the gloss roll and the pressure roll can be adjusted to change the gloss levels. In another embodiment, a secondary fusing treatment is selected for some or all the images in a print job to increase consistency between images of the print job. It will be appreciated that in place of or in addition to an offline gloss sensor 120, the system of FIG. 4 may include an online sensor similar to sensor 100 and that the printing system of FIG. 3 may communicate with an off-line sensor similar to sensor 120.

Figure 5:
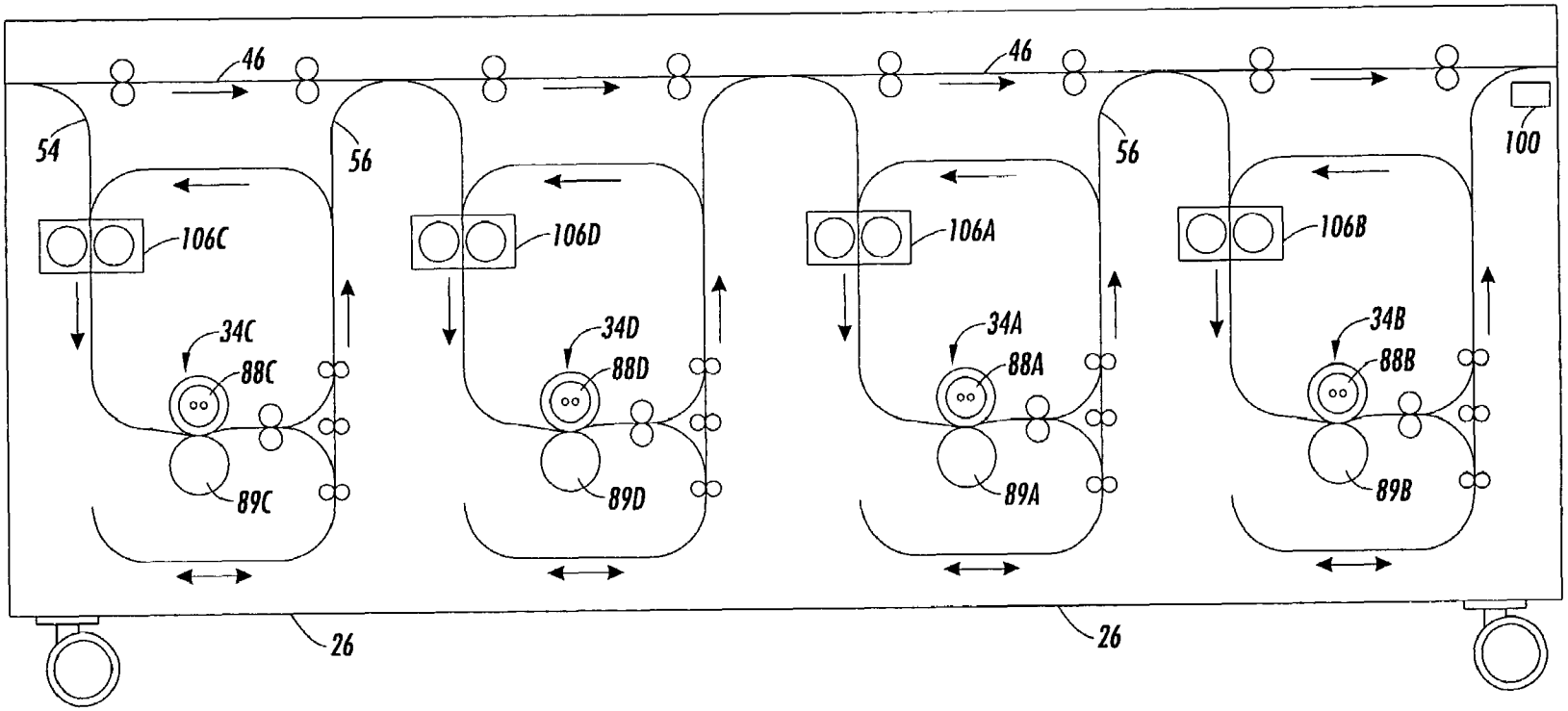
FIG. 5 is a schematic view of another embodiment of a secondary fusing module.

With reference now to FIG. 5, another embodiment of a secondary fusing module 26 is shown, where similar elements are given the same numerals and new elements are accorded new numerals. The modular fusing system may replace the module 26 of FIG. 2, 3 or 4, for example. The module 26 of FIG. 5 includes a plurality of secondary fusing devices 34A, 34B, 34C, 34D (four in the illustrated embodiment) in the form of individually replaceable submodules, which are arranged in a parallel tandem array. The fusing devices 34A, 34B, 34C, 34D are linked to the main highway 46 by paper pathways 54, 56, such that printed media may be directed to any one of the secondary fusing devices 34A, 34B, 34C, 34D, or sequentially, to more than one of the submodules. One or more of the secondary fusing devices 34A, 34B, (which will be referred to as "appearance stations") may be similarly configured to the fusing device 34 of FIG. 2 and be under the control of a control system similar to control system 25. The secondary fusing devices 34A, 34B, can be used for final appearance correction, e.g., minor modifications to the image achieved by varying the heat and or pressure applied to the image. One or more of the remaining devices 34C, 34D (which will be referred to as "fixing stations") may be configured for gross modification of the fusing (fixing and/or gloss) which benefits from a blanket treatment of the entire image. The devices 34C, 34D need not be under the control of the control system 25 and can be configured similar to conventional fusers. A sheet may thus pass first through a fixing device 34C, 34D for gross modification of the fusing characteristics (fixing and/or gloss), followed by a final treatment in one of the final appearance devices 34A, 34B. In this way, the final appearance devices 34A, 34B can function in a narrow tolerance range, and with greater accuracy. As with the embodiment of FIGS. 2-4, the image, before reaching any one of the modules 34A, 34B, 34C, 34D, has already been subjected to one or more of the primary fixing devices 24A, 24B, and 24C in the individual marking devices 22A, 22B, and 22C. It will be appreciated that there may be any number of appearance stations and fixing stations in the module 26, such as N fixing stations and M appearance stations, where N and M can be 0, 1, 2, 3, 4, 5, etc, and N+M is at least 1, and in one embodiment, at least 2.

The secondary fusing systems of FIGS. 3 and 5, with multiple fusing devices operating in parallel, enables lower speed fusing through a combination of parallelism (splitting a print job among multiple secondary fusing devices) and sheet buffering. As a result, the secondary fusing devices 34A, 34B, 34C, 34D can operate at somewhat lower temperatures/pressures than would otherwise be the case. Multipass fusing, in which sheets are routed through the one or more modules multiple times in order to obtain target levels of fixing and appearance, also allows the individual fusing devices to operate at lower temperatures and/or pressures. Settings for the various fixing stations and appearance stations need not all be the same and can be optimized according to job content.

The system of FIG. 5 can also include one or more preheaters 106A, 106B, 106C, 106D, which reduces the heat input required in the secondary fusing devices. This also facilitates a choice of more robust materials for the gloss roller and conditions for achieving high glossing reliability.

With particular reference to FIG. 4, the secondary fusing module 26 of any of the illustrated embodiments may also include one or more varnishing stations 108 which apply a varnish to the printed media. The varnish can be used to modify the gloss of the printed media, for example, to achieve gloss uniformity between images, or serve other functions, such as providing a protective coating. While the varnishing station is illustrated in FIG. 4 as being located downstream of the secondary fusing device 34 it will be appreciated that another suitable location in the printing system 10 may be selected.

The system 10 of FIGS. 3-5 can be operated under various modes of operation, the following being given as examples. In one mode of operation, an entire print job, or selected portions thereof, have a specific appearance requirement (e.g., a preselected minimum gloss level, an acceptable gloss range, or an acceptable maximum level of variation in the gloss levels between images). In this mode, a developed printed substrate enters either fusing device 22A or fusing device 22B to be fixed to a permanence level which allows the substrate to travel through the paper path to be subsequently processed by one or more of the secondary fusing devices 34A, 34B, (and 34C, 34D, where present). As noted above, the secondary fusing device selected for final appearance modification of one portion of print media may be different from that selected for a second portion. For example, the secondary fusing device selected for final appearance modification of print media from one marking device 22A may be different from that selected for a second marking device 22B. For example, if the outputs of the primary fusing devices 24A, 24B differ, one of the secondary fusing devices may be set at a higher temperature/pressure than the other to compensate for the variation.

In a second mode of operation, there is no specified appearance requirement for a print job or selected developed sheets of print media. In this mode, a developed sheet of printed media enters either fusing device 24A or fusing device 24B to be fused to a final appearance level. The fused printed media can bypass the secondary fusing module 26 if the primary fusing devices are able to achieve the desired throughput while achieving a minimum acceptable level of fixation.

In a third mode of operation, the entire print job or selected portions thereof have a specific appearance requirement, however, the secondary fusing module 26 is disabled. In this mode, a developed printed substrate enters either fusing device 24A or 24B where the fusing is selected to achieve final appearance and permanence levels. The fused substrate bypasses the secondary fusing module 26. The operating temperature of the fusing devices 24A, 24B is typically at a general higher temperature than for the second operation mode to achieve a desired gloss level.

In a fourth mode of operation, the secondary fusing module 26 is used as a primary and as a secondary fusing device system; this could be as a result of a failure of one of the primary fusing devices 24A, 24B. In this mode, the secondary fusing module 26 can perform some or all of the functions of the previous three modes. In this mode, the print job or selected developed substrates may bypass one or both primary fusing devices 24A, 24B and are fused within the secondary fusing module 26. This mode is generally more applicable to inkjet or other printing systems where the image can travel some distance without risking detachment from the sheet.

Parsing the fusing function for an integrated printing system can have several advantages. First, the individual marking devices in the system need only use enough heat and/or pressure to provide in situ permanence, resulting in longer lifetimes of the fusing devices. The dual fusing system enables at least a portion of the function of achievement of gloss levels, which is normally provided by the primary fusing devices located within the marking devices, to be transferred to the secondary fusing device(s). The reliability issues arising from the desire to provide simultaneous achievement and maintenance of high and uniform gloss by the primary fusing devices are addressed.

In systems with multiple marking devices, the reliability of the overall system can be improved. The cost of a printing system is reduced as a result of the much broader tolerances permitted in the outputs of the individual marking devices.

Material selection for the primary fuser rolls can be targeted to longer life materials due to the lower fusing requirements (temperature and/or pressure).

Paper handling can also benefit from the use of a secondary fusing module to provide at least a portion of the permanence and/or final appearance of the flexible media. Specifically, heat, and other forms of fusing tend to influence paper shrinkage, curl, and similar properties which affect sheet registration. By minimizing the heat or other fusing parameter used in each marking device 22A, 22B, and 22C, these paper handling effects can be mitigated.

Another advantage of the dual fuser system is that higher throughputs can be achieved by reducing the constraints the integral fusing devices 24A, 24B, and 24C place on the marking devices 22A, 22B, and 22C. In a conventional printing system, the throughput of the fusing device often limits the throughput of the marking device 22A, 22B, and 22C and thus of the overall printing assembly 16. The dual fusing system allows higher throughputs for each of the marking devices and thus a higher total productivity to be achieved. The primary fusing devices can be run at higher operating speeds and any lack of fusing compensating for in the secondary fusing device(s).

Further, particularly in systems where two or more marking devices are contributing to the same document, consistency in the appearance of printed media from the different marking devices can be improved by using the secondary fusing device(s) to compensate for discrepancies between the outputs of the primary fusing devices.

Additionally, a user can select a wider range of gloss levels, from a low gloss level (which may be achieved by bypassing the secondary fusing device) to a high gloss level, without necessarily impacting the overall output speed of the printing system or risking undue wear on the primary fusing devices.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

The invention claimed is:

1. A printing system comprising:

first and second marking devices for applying images to print media;

a primary fusing device associated with each of the first and second marking devices for applying a primary fusing treatment to the images applied to print media by the first and second marking devices; and a secondary fusing module which receives printed media from the first and second marking devices, the secondary fusing module including first and second secondary fusing devices which selectively apply a further fusing treatment to the images applied to the printed media.

2. The system of claim 1, wherein the first marking device and the second marking device are operatively connected to each other for printing images onto print media from a common electronic print job stream.

3. The system of claim 1, wherein the secondary fusing devices each include a heater for heating fused images from the first and second marking devices to achieve printed images having an appearance level which is within a predefined range.

4. The system of claim 1, further comprising a control system which controls operations of the printing system, the control system communicating with the secondary fusing module.

5. The system of claim 4, wherein the control system selectively directs printed media to one of the first and second secondary fusing devices to reduce inconsistencies between the appearance of printed images from the first marking engine and the appearance of printed images from the second marking engine.

6. The system of claim 4, wherein the control system comprises an appearance controller which controls at least one of:

operating parameters of at least one of the first and second secondary fusing devices to achieve a desired fusing characteristic; and selection of an appropriate one of the first and second secondary fusing devices to achieve a desired fusing characteristic.

7. The system of claim 6, wherein the fusing characteristic comprises at least one of an appearance characteristic and a permanence characteristic.

8. The system of claim 6, further comprising a user interface, in communication with the appearance controller, for selecting a desired appearance level of printed media.

9. The system of claim 4, further including an appearance sensor which detects an appearance level of printed images, the appearance sensor being in communication with the control system for generating a control signal if a detected gloss level is outside a predefined target range.

10. The system of claim 1, further comprising:

a conveyor system which links the first marking device and the second marking device with the secondary fusing module for conveying printed media from the first and second marking engines to the secondary fusing module.

11. The system of claim 1, wherein the printing system comprises:

a first mode of operation wherein images are fused by one of the primary fusing devices to achieve a predefined permanence level and are routed to a selected one of the first and second secondary fusing devices;

a second mode of operation wherein images are fused by one of the primary fusing devices to achieve a predefined permanence level and are routed to bypass the final appearance module.

12. The system of claim 1, wherein the primary fusing devices fuse images to at least a minimum predetermined permanence level to prevent fused images exiting from the first and second marking devices from being disturbed while being transported through the printing system.

13. The system of claim 1, wherein the secondary fusing module further comprises a preheating station for preheating partially fused images on the printed media prior to the further fusing treatment.

14. A xerographic system comprising:

a plurality of marking devices for applying images to print media;

a primary fusing device associated with each of the marking devices for applying a primary fusing treatment to the applied images exiting the marking devices;

a plurality of secondary fusing devices which selectively receive printed media from the marking devices and apply a further fusing treatment to the applied images thereon;

a print media conveyor which conveys print media between the marking devices and the secondary fusing devices; and a control system which controls operations of the printing system, the control system comprising a paper path controller which selectively directs print media from at least one of the plurality of marking devices to at least one selected secondary fusing device from the plurality of secondary fusing devices for achieving a predefined fusing characteristic.

15. The xerographic system of claim 14, wherein the further fusing treatment modifies a fusing characteristic of the printed media, the fusing characteristic comprising at least one of degree of fixing and level of gloss.

16. The xerographic system of claim 14, further comprising a sensor which senses a fusing characteristic of the printed media or a property of the image related to a fusing characteristic, the sensor providing feedback on the sensed characteristic or property to the control system.

17. A method of printing comprising:

applying images to print media;

applying a primary fusing treatment to the applied images to form printed media, and applying a secondary fusing treatment selected from a plurality of secondary fusing treatments to at least a portion of the printed media to modify an appearance level of the at least a portion of the printed media.

18. The method of claim 17, wherein the secondary fusing treatment increases consistency in the appearance of the printed media.

19. The method of claim 17, further comprising:

evaluating whether a primary fusing treatment achieves preselected fusing characteristics for the printed media; and where the primary fusing treatment does not achieve the preselected fusing characteristics, selectively applying the secondary fusing treatment to achieve the achieved preselected fusing characteristics.

* * * * *